US005782231A

United States Patent [19]

Wade

[11] Patent Number: 5,782,231

[45] Date of Patent: Jul. 21, 1998

[54] DIRECT VENT FIREPLACE

[75] Inventor: Melvin Wade, Bridgeport, Ala.

[73] Assignee: Temco Fireplace Products, Inc., Nashville, Tenn.

[21] Appl. No.: 804,815

[22] Filed: Feb. 24, 1997

[51] Int. Cl.[6] ..... F24B 1/188; F24C 15/04

[52] U.S. Cl. ..... 126/200; 126/523; 126/531; 126/512

[58] Field of Search ..... 126/512, 529, 126/530, 531, 200, 528, 523, 515, 516, 517, 518, 60, 61, 62, 63, 64, 65, 66, 67; 110/173 B

[56] References Cited

U.S. PATENT DOCUMENTS

| | | | |
|---|---|---|---|
| 3,000,374 | 9/1961 | Lund | 126/67 |
| 3,190,279 | 6/1965 | Davis | 126/531 |
| 5,022,380 | 6/1991 | Faurel et al. | 126/200 |
| 5,249,567 | 10/1993 | Maitland et al. | 126/512 |
| 5,471,973 | 12/1995 | Wilhoite | 126/200 |
| 5,542,407 | 8/1996 | Hawkinson | 126/515 |

FOREIGN PATENT DOCUMENTS

| | | | |
|---|---|---|---|
| 523912 | 1/1993 | European Pat. Off. | 126/512 |

*Primary Examiner*—Carl D. Price
*Attorney, Agent, or Firm*—Alan Ruderman

[57] ABSTRACT

A gas burning direct vent fireplace having an outer casing within which a firebox is mounted. The sides of the firebox are secured to the sides of the casing so that the bottom of the firebox is spaced above the floor of the casing without the need for supporting legs for the fireplace. An access door having a glass plate is fastened to the firebox at the front and a front panel is removably carried by the casing in front of and spaced from the glass plate access door, the front panel having an opening permitting viewing of the interior of the firebox through the glass plate. The mounting of the front panel permits a variety of selective front panels having varying aesthetics to be used with a fireplace.

11 Claims, 4 Drawing Sheets

DIRECT VENT FIREPLACE

BACKGROUND OF THE INVENTION

This invention relates a gas burning direct vent fireplace having a removable selectively replaceable front panel and a glass access door, the front panel and glass access door being spaced apart and independent of one another, and the firebox being spaced above the floor.

In the prior art, the frames of the glass access door and the front panel are the same. In other words, the glass is mounted in the front panel. Inasmuch as the front panel faces the interior of the room, the front of the front panel or face of the fireplace has an aesthetic function. In the prior art if it is desired to change the front panel aesthetics, the front panel together with the glass panel must be changed. Thus, each direct vent fireplace when leaving the manufacturing facility has a specific front panel or face. The capability of supplying the front panel as a separate member from the glass would be most convenient and economical. In such a case, the consumer may purchase the fireplace with everything included and have a choice of front panels which may be readily mounted on a firebox. The front panels of various designs and aesthetics may be mounted in front panel boxes separate from the remainder of the fireplace and the consumer at the time of purchasing such a fireplace would then have the capability of selecting a front panel to be mounted thereon. The glass access door frame together with the glass panel would be mounted in the firebox and shipped therewith.

Additionally, the firebox of direct vent fireplaces in the known prior art are mounted on legs or the like on a floor within an outer housing. The controls for the gas are mounted beneath the firebox above the floor of the outer housing. The space between the firebox and the floor of the outer housing is somewhat limited, and when maintenance of the controls is required, it becomes difficult. Moreover, this space, although it may permit an air moving device such as a fan or a blower to be mounted beneath the firebox to aid in circulating room air below, in the rear of and over the top of the firebox and back into the room as heated air, the size of the air moving device is limited. Of course, if a larger fan or blower could be mounted beneath the firebox a greater amount of air may be circulated for adding larger amounts of heated air into the room, thereby to provide a greater heating efficiency for the fireplace.

SUMMARY OF THE INVENTION

Consequently, it is a primary object of the present invention to provide a direct vent fireplace having a glass plate access door and a selectively replaceable front panel spaced from the glass plate and independently mounted relative thereto so that various front panels may be selectively mounted on the fireplace.

It is another object of the present invention to provide a direct vent fireplace wherein the firebox is mounted within an outer housing spaced above the floor of the outer housing to provide a substantially open space between the floor of the outer housing and the floor of the firebox.

It is a further object of the present invention to provide a direct vent fireplace having a front panel spaced from a separately mounted glass access door, the access door being connected to the firebox and the front panel being connected to the outer housing within which the firebox is mounted, thereby to permit different aesthetic front panels to be selectively connected to the fireplace.

Accordingly, one aspect of the present invention provides a direct vent fireplace having an outer casing or housing within which the firebox of the fireplace is mounted, an access door having a glass plate fastened to the firebox within the outer casing at the front thereof and a front panel readily removably fastened to and carried by the outer casing in front of and spaced from the glass plate access door, the front panel having an opening permitting viewing through the glass plate of the interior of the firebox. Thus, a variety of front panels may be utilized selectively with the remainder of the fireplace and may be packaged, shipped and stored separately therefrom. If a consumer prefers the aesthetics of one front panel when purchasing a fireplace, the container having that front panel is provided with the fireplace container. A glass plate access door may be mounted on the firebox and shipped with it so that the access door and the front panel would be packaged and shipped separately.

Another aspect of the present invention comprises suspending the firebox from the casing above the floor thereby to eliminate the use of supporting legs and provide an enlarged space beneath the firebox for ease of installation of gas lines, maintenance of gas controls and for mounting a larger air circulating blower or fan to circulate greater amounts of room air about the firebox for re-entry into the room at a higher temperature. Preferably, the firebox is supported by the side walls of the casing.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
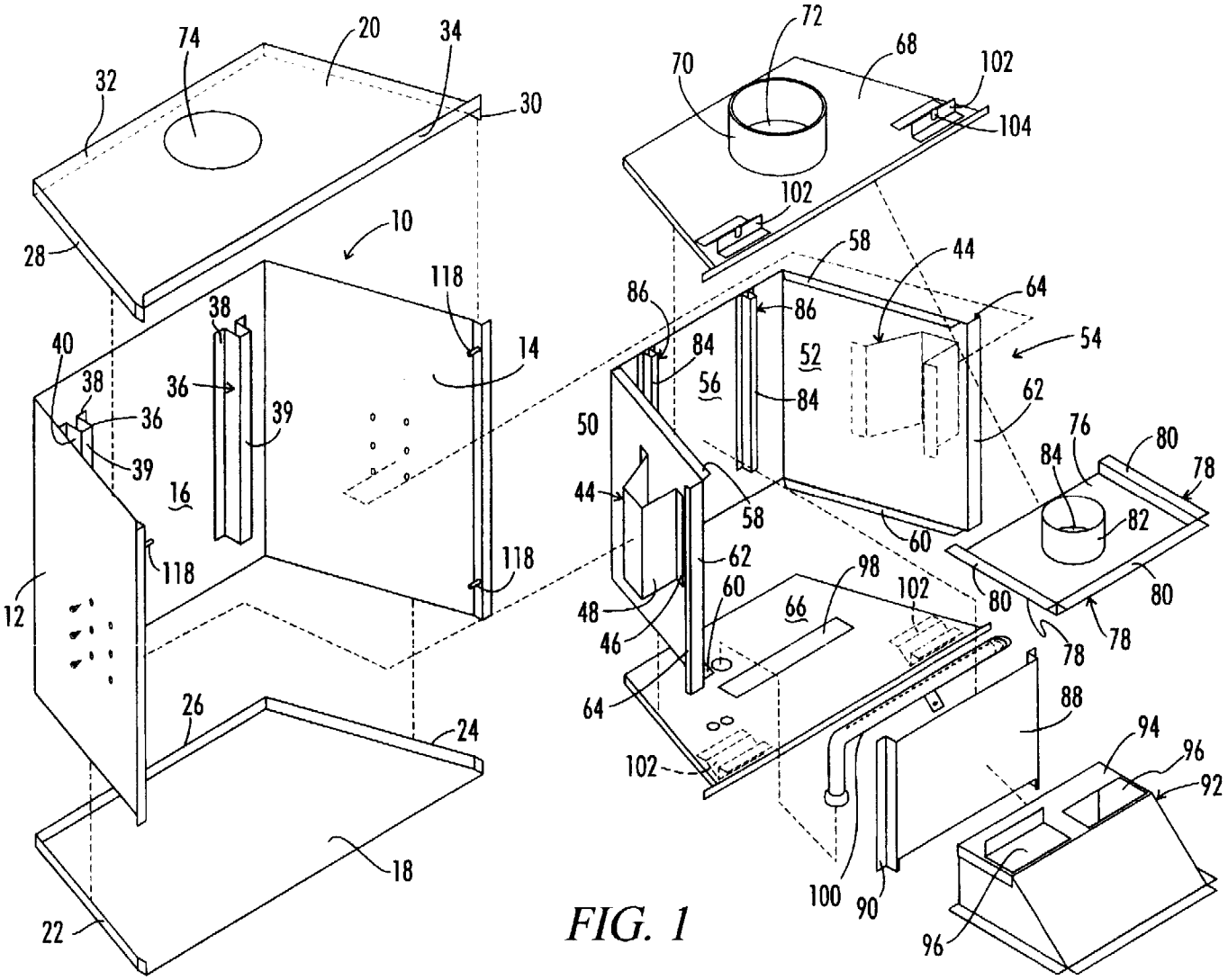
FIG. 1 is an exploded or disassembled perspective view illustrating substantially all the components of the casing and firebox of a direct vent gas fireplace constructed in accordance with the present invention.

Referring now to the drawings, a gas burning direct vent fireplace of the present invention, as best illustrated in FIG. 1, includes a length of sheet metal forming the outer shell or casing 10 comprises side panels 12 and 14, and rear panel 16. The side panels as illustrated in the drawings preferably may be at an obtuse angle to the rear panel for aesthetics and to simulate a conventional fireplace. The sheet metal may be 28 gauge and thus may have a thickness of approximately 0.02 inch and therefore is relatively thin. The lower edges of the panels 12, 14, and 16 may rest on a base member 18 having a configuration in plan substantially the same as the casing 10 provides the floor of the fireplace and rests on the floor of the room in which the fireplace may be mounted (not illustrated). A top plate forming the ceiling of the casing 10 having a similar configuration to the bottom plate 18 is disposed at the upper portion of the casing. The bottom plate 18 includes upwardly extending lip members 22, 24, 26 at the sides and rear respectively while the ceiling member 20 includes similar lips at the sides and rear 28, 30 and 32 respectively, the lips on the bottom plate extending upwardly while the lips on the ceiling plate extend downwardly, the lips being utilized for securing the side walls and rear wall of the casing to the respective bottom and ceiling plates. The ceiling plate additionally may include an upwardly extending lip 34 for positioning against an interior wall structure of the room in which the fireplace is mounted. A pair of spaced apart vertically elongated spacer members 36 having a substantially U-shape configuration including a pair of laterally extending legs or wings 38 are welded or fastened by threaded fasteners to the rear wall 16 of the casing 10, the depth of the legs 40 of the U-shape members from the rear panels forwardly have a dimension so as to keep the rear of the firebox spaced from the rear panel 16 of the casing for reasons hereinafter made clear.

Secured as by threaded fasteners 42 to each of the side walls 12, 14 of the casing 10 is a substantially U-shape bracket member 44 having a respective wing 46 extending sidewise from each leg 48, the wings 46 being secured to the central portion of a respective side wall 50, 52 of the firebox 54. The firebox includes a rear wall 56 and has substantially the same configuration in plan as the casing 10. The rear of the rear wall 56 abuts and is fastened to the spacers 36 extending forwardly from the rear wall 16 of the casing. Each of the side walls 50, 52 of the firebox at the upper edge includes an inward extending lip 58 and at the lower edge a similar lip 60 facing toward the opposite side wall. Preferably, each side wall at the front may include a wing 62 extending sideways or laterally away from the opposite side wall and having a rearwardly extending lip 64. The lower surfaces of the lips 60 are fastened to the bottom panel 66 forming the floor of the firebox, the panel 66 having a shape conforming to the planar shape of the firebox 54.

Figure 2:
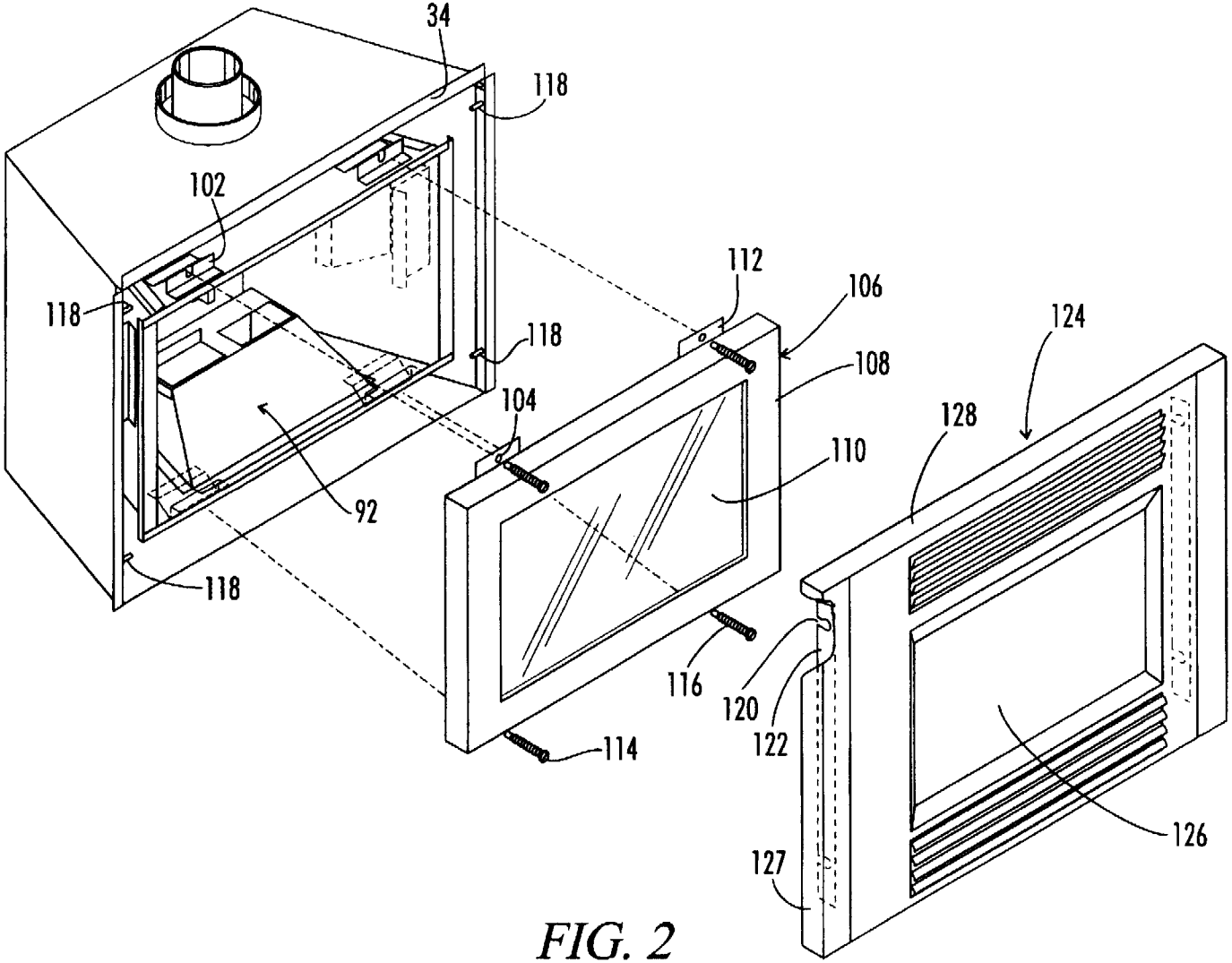
FIG. 2 is a perspective assembled view of the fireplace illustrated in FIG. 1 with the glass access door and the front panel separated therefrom.
Figure 4:
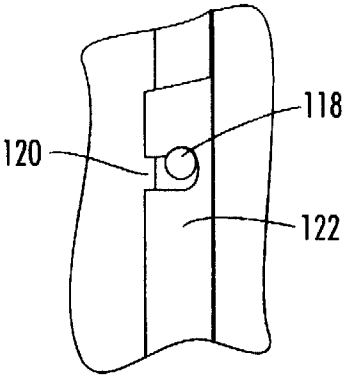
FIG. 4 is an enlarged elevational view illustrating the manner in which the front panel is mounted to the outer casing of the fireplace.
Figure 3:
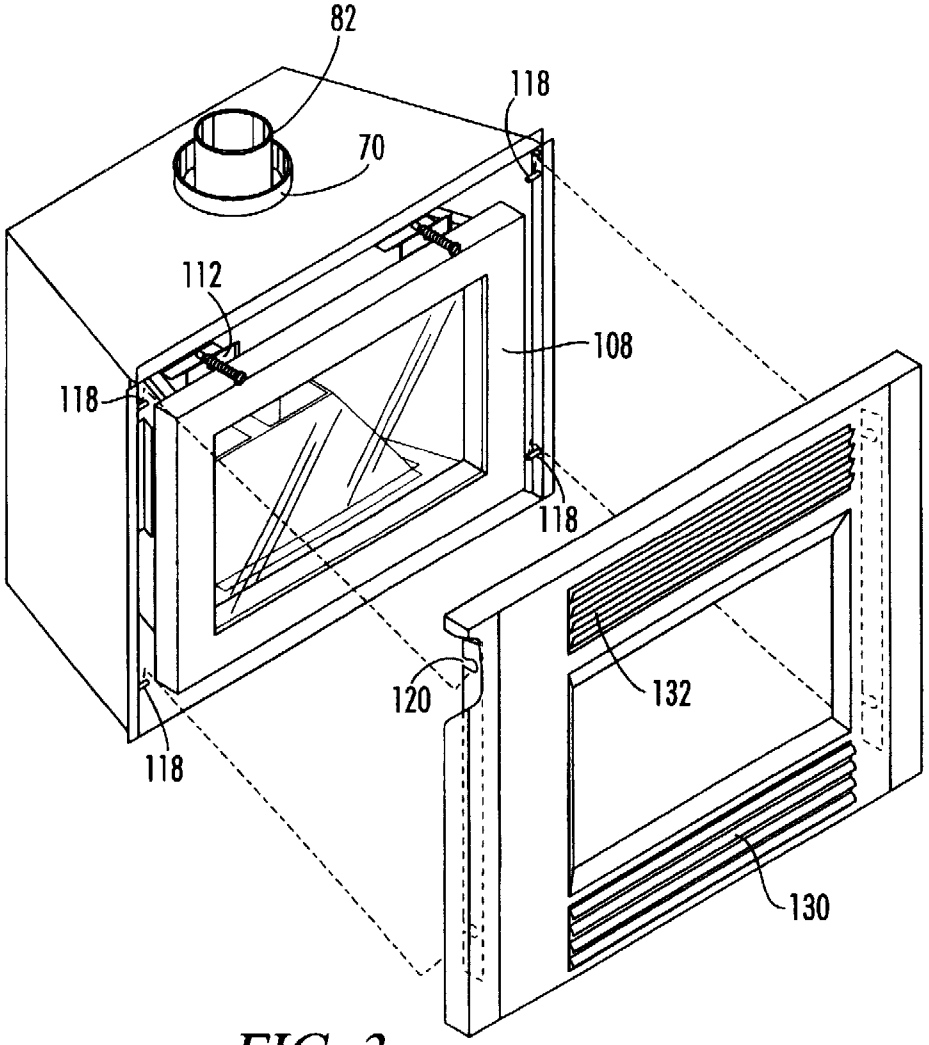
FIG. 3 is a view similar to FIG. 2, but with the glass access door assembled to the firebox.
Figure 5:
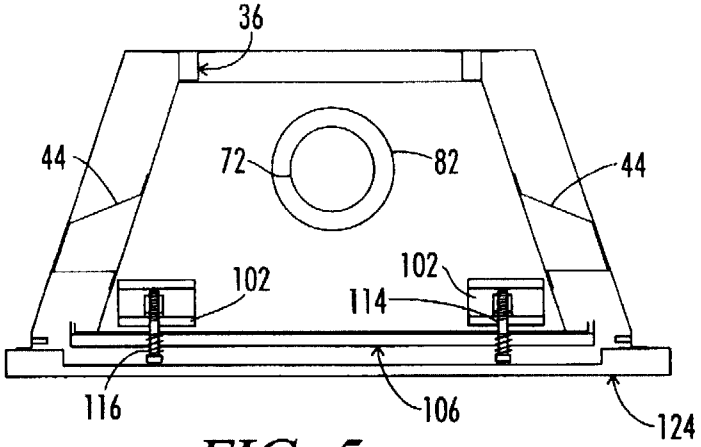
FIG. 5 is a top plan view of the assembled fireplace with the top of the casing removed.
Figure 6:
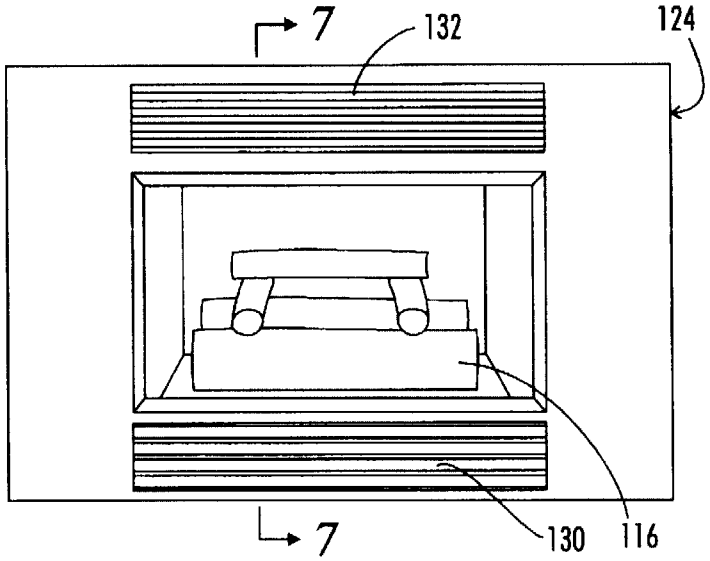
FIG. 6 is a front elevational view of the fireplace.
Figure 7:
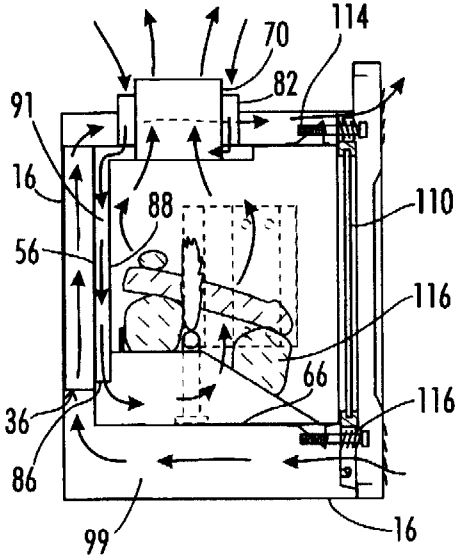
FIG. 7 is a vertical cross sectional view taken substantially along line 7—7 of FIG. 6.

At the top of the firebox the bottom of a ceiling panel 68 is fastened as by welding to the upper surface of the lips 58. The ceiling panel includes a small cylindrically shaped upwardly extending conduit 70 secured to the periphery of a circular aperture 72, the conduit 70 being received through a circular aperture 74 in the top panel 20 of the casing 10. As illustrated in FIGS. 2, 3 and 7, the height of the firebox panels 50, 52 and 56 are less than the casing panels 12, 14 and 16 so that the bottom panel 66 is spaced above the floor panel 16 of the casing 10, and the ceiling panel 68 of the firebox is disposed in abutment with the front facing surfaces 39 at the ends of the legs 38 of the spacers 36 thereby to provide a channel between the rear panels 16, 56 for air to flow between the firebox and the casing below, behind and above the firebox. Moreover, a plate 76 having inverted L-shaped members 78 at the sides and front thereof with laterally extending lips 80 and an upstanding cylindrical conduit 82 secured to the periphery of a centrally disposed circular aperture 84 is welded to the lower surface of the ceiling panel 68, the attachment being at the lips 80. When the ceiling panel 68 and the top of the casing 20 are so disposed, the conduit 82 is concentric with the conduit 70 and extends upwardly therethrough.

The rear edge of the plate 76 when the plate is positioned as aforesaid, abuts the forward facing surface 84 of a pair of spaced apart spacers 86 fastened to the rear wall 56 of the firebox, the spacers 86 being similar to the spacers 36 on the rear panel 16 of the casing 10. Additionally, a baffle plate 88 having L-shape lips 90 stepped rearwardly from the rear surface thereof is fastened to the surfaces 84 of the spacers 86, the lips 90 being welded or otherwise connected thereto. Thus, an inlet air channel 91, as best illustrated in FIG. 7, is formed between the spacers 86 and between the plate 76 and the ceiling panel 68 and between the baffle 88 and the rear wall 56, the channel opening at the top into the conduit 82 in the annulus between the conduits 70 and 82 and therefore to fresh air at the outside of the building within which the fireplace is mounted. The channel 91 also opens at the bottom below the spacers 86 and the plate 88. A sheet metal hearth 92 fastened to the floor 66 has a rear upper portion 94, the back of which is open and communmicates with the bottom of the channel 91 to provide fresh air into the hearth. The hearth includes at least one and preferably two openings 96 in the portion 94 which communicates the hearth to the supply air for combustion. An opening 98 in the floor 66 may supply primary combustion air flowing from the room in a channel 99 between the floor 66 of the firebox and the bottom panel 18 of the casing when the gas fuel is first ignited. Generally, however, the channel 99 provides room air about the firebox and returns warm air to the room. A gas fuel supply tube 100 extends upwardly from the floor 66 and is disposed on the hearth behind the opening 96.

Secured to the top of the ceiling 68 and the bottom of the floor 66 adjacent the front edges and the sides is a respective bracket 102 having a respective tapped bore 104, the bore extending front to rear and opening at least at the front as illustrated. An access panel 106 having a frame 108 has a glass plate 110 securely fastened and sealed in the central portion of the frame, the panel 106 being positioned in the front of the firebox as illustrated in FIG. 2. The frame 108 has integral or securely fastened tabs 112 for receiving bolt members 114 having springs 116 disposed about the shanks thereof. The bolts 114 are securely threaded into the bores 104 in the tabs 102, as illustrated in FIGS. 2 and 3, to fasten the access panel 106 to the front of the firebox after gas logs 116 are disposed on the top of the hearth 92. Should a gas build-up result in an explosion in the firebox the springs absorb the force and permit the access panel to move outwardly.

Fixed in the front of the side panels 12, 14 of the casing 10 is a plurality of pegs 118, there being four such pegs as best illustrated in FIGS. 2 and 3. The pegs 118 are aligned in registration with an equal number of slots 120 formed in a pair of spaced apart vertical rails 122 in the front panel 124 when the front panel is to be mounted on the fireplace. Half of the total number of slots 120 are disposed in each rail 122 so that in the preferred embodiment, as illustrated in the drawings, the four pegs 118 are received in four slots 120 in the pair of rails 122, there being two slots in each rail of the front panel 124. The front panel 124, which has a central window 126 superposed over the glass 110 of the access plate 106 to view the flames within the fireplace, may thus be removably attached to the casing 10 of the fireplace. The border of the front panel is larger than the border of the front of the casing 10 and includes a pair of sides 127 (only one of which is illustrated), a top 128 and may have a bottom member if desired. Thus, the sides, top and bottom of the front panel when the front panel is mounted on the casing encloses and covers the casing. The front panel, which includes lower and upper grills 130, 132 to permit room air to enter the channel 99 and exhaust into the room as warm air, may have any desired aesthetic motif. Therefore, selected front panels may be interchangeably mounted on the casing 10 by positioning the slots 120 to receive the respective pegs 118. The front panels thus may be packaged individually and transported in separate containers from that of the fireplace and selected subsequently by a customer for readily providing the desired aesthetics to the fireplace.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

What is claimed is:

1. A fireplace comprising a casing and a firebox mounted within said casing, a glass access door having a frame carrying a glass plate fastened to said firebox at the front thereof for viewing the interior of said firebox, a front panel including a unitary frame removably fastened to and carried by said casing spaced forwardly of said glass access plate, and said front panel having a central opening defining a window to permit viewing of the interior of said firebox through said glass plate.

2. A fireplace as recited in claim 1, wherein said frame of said glass access door includes spring biased bolt means for fastening said access door to said firebox permitting said access door to move away from said firebox toward said front panel without abutting said front panel in the event of an explosion in said firebox.

3. A fireplace as recited in claim 1, wherein said casing comprises a rear panel and a pair of side panels connected to said rear panel and a base connected to said panels, said firebox comprising a rear wall, a pair of spaced apart side walls connected to said rear wall and a bottom wall connected to said rear wall and said side walls, said firebox having a smaller cross sectional configuration than said casing in the laterally extending vertical plane, and said glass access door a smaller periphery than said front panel.

4. A fireplace as recited in claim 3, wherein said frame of said glass access door includes spring biased bolt means for fastening said access door to said firebox permitting said access door to move away from said firebox toward said front panel without abutting said front panel in the event of an explosion in said firebox.

5. A fireplace comprising an outer casing having a rear panel and a pair of side panels connected to said rear panel, a base connected to said rear panel and said side panels, a firebox comprising a rear wall and a pair of side walls connected to said rear wall, a bottom wall connected to said rear wall and said side walls, said rear wall being smaller in height and width than said rear panel, said side walls being smaller in height and depth than said side panels, means including bracket members for securing each side wall to a respective side panel for suspending said firebox from said casing with said bottom wall spaced above said base to provide a clear space beneath said firebox between said firebox and said casing and a space above said firebox between said firebox and said casing, a pair of vertically disposed spaced apart spacer members fastened to said rear panel, said rear wall abutting said spacer members, said spacer members providing a channel between said spacer members communicating said space beneath said firebox with said space above said firebox to permit air to flow about said firebox, and means permitting air to enter and exit said channel at the front of said casing.

6. A fireplace as recited in claim 5, including a glass access door having a frame and a glass plate mounted in a central portion of said frame fastened to said firebox remote from said rear wall, and a front panel removably carried by said side panels of said casing.

7. A fireplace as recited in claim 6, wherein said front panel is spaced from said glass access door, spring biased bolt means for fastening said glass access door to said firebox while permitting said access door to move away from firebox toward said front panel without abutting said front panel should an explosion in said firebox occur.

8. A fireplace as recited in claim 6, wherein said front panel includes a plurality of slots adjacent side borders thereof, said slots opening rearwardly, and a plurality of pegs equal in number to said slots fastened to opposite sides of said side panels adjacent front edges thereof, said front panel being positioned to align said slots with said pegs for removably mounting said front panel to said casing.

9. A fireplace as recited in claim 5, wherein said firebox includes a pair of vertically disposed spacer members fastened to said rear wall, a baffle plate fastened to said spacer members spaced from said rear wall to define an air channel laterally between said spacer members and vertically between said rear wall and said baffle plate, said baffle plate being spaced above said bottom wall of said firebox to communicate said air channel with said firebox, and means communicating said air channel with outside air.

10. A fireplace as recited in claim 9, including a glass access door having a frame and a glass plate mounted in a central portion of said frame fastened to said firebox remote from said rear wall, and a front panel removably carried by said side panels of said casing spaced from said glass access door.

11. A fireplace as recited in claim 10, including spring biased bolt means for fastening said glass access door to said firebox while permitting said access door to move away from firebox toward said front panel without abutting said front panel should an explosion in said firebox occur.

* * * * *